US006464653B1

(12) United States Patent
Hovland et al.

(10) Patent No.: US 6,464,653 B1
(45) Date of Patent: Oct. 15, 2002

(54) CLITORAL TREATMENT DEVICES AND METHODS

(75) Inventors: Claire T. Hovland, Andover; Curtis E. Olson; Jerome H. Abrams, both of St. Paul, all of MN (US)

(73) Assignee: UroMetrics, Inc., St. Paul, MN (US)

( * ) Notice: Subject to any disclaimer, the term of this patent is extended or adjusted under 35 U.S.C. 154(b) by 0 days.

(21) Appl. No.: 09/442,803

(22) Filed: Nov. 18, 1999

Related U.S. Application Data

(60) Provisional application No. 60/158,257, filed on Oct. 6, 1999, and provisional application No. 60/108,959, filed on Nov. 18, 1998.

(51) Int. Cl.[7] ..... A61H 7/00
(52) U.S. Cl. ..... 601/7; 601/6
(58) Field of Search ..... 601/6, 7, 9–11, 601/13, 14; 128/842; 604/22

(56) References Cited

U.S. PATENT DOCUMENTS

| | | | | |
|---|---|---|---|---|
| 882,532 A | | 3/1908 | McCall | |
| 1,201,767 A | * | 10/1916 | Schimek et al. | 601/6 |
| 1,704,960 A | | 3/1929 | Ackerman | |

(List continued on next page.)

FOREIGN PATENT DOCUMENTS

| | | |
|---|---|---|
| DE | 2207169 | 9/1972 |
| DE | 3426225 A1 | 1/1986 |
| DE | 9014988 | 1/1991 |
| EP | 0 148 586 A1 | 7/1985 |
| GB | 1522674 | 8/1978 |
| GB | 2 120 944 A | 12/1983 |
| GB | 2126900 | 4/1984 |
| GB | 2 191 700 A | 12/1987 |
| GB | 2 279 874 A | 1/1995 |
| JP | 53-4649 | 1/1978 |
| JP | 53-4652 | 1/1978 |
| JP | 54-115951 A | 9/1979 |

OTHER PUBLICATIONS

Levin, R., "The physiology of sexual founction in women," Clinical Obstetr Gyn, 7:213, 1980.
Diederichs, W., et al., "Clitoral response to cavernous nerve stimulation in dogs," International Journal of Impotence Research, 3:7, 1991.
Wagner, G., "Aspects of Genital Physiology and Pathology," Seminars in Neurology, 12:87, 1992.
Levin, R., "The mechanisms of human female sexual arousal," Annual Review of Sex Research, 3:1, 1992, abstract.
Schiavi, R., et al., "The biology of sexual function," Psychiatric Clinics of North America, 18:7, Mar. 1995.
Park, K., et al., "Vasculogenic female sexual dysfunction: The hemodynamic basis for vaginal engorgement insufficiency and clitoral erectile insufficiency," International Journal of Impotence Research (1997) 9, 27–37.
Burnett, A., et al., "Immunohistochemical Description of Nitric Oxide Synthase Isoforms in Human Clitoris," Journal of Urology, vol. 158, 75–78, Jul. 1997.
Goldstein, I., et al., "Vasculogenic female sexual dysfunction: vaginal engorgement and clitoral erectile insufficiency syndromes," International Journal of Impotence Research (1998) 10, Suppl. 2, S84–S90.

(List continued on next page.)

*Primary Examiner*—Justine R. Yu
(74) *Attorney, Agent, or Firm*—Dicke, Billig & Czaja, P.A.

(57) ABSTRACT

Therapeutic devices and methods according to embodiments of the invention encourage or cause clitoral engorgement to assist in the treatment of female sexual dysfunction. A vacuum is created over the clitoris, or suction is applied to the clitoris, to create a negative pressure in the clitoris that is lower than the systolic blood pressure. This tends to promote engorgement of the clitoris with blood.

22 Claims, 15 Drawing Sheets

U.S. PATENT DOCUMENTS

| | | | | |
|---|---|---|---|---|
| 1,730,535 | A | | 10/1929 | Rudolph |
| 1,762,692 | A | | 6/1930 | Lair |
| 1,858,209 | A | | 5/1932 | Lang |
| 1,861,924 | A | | 6/1932 | Karlstrom et al. |
| 1,882,040 | A | * | 10/1932 | Roehm |
| 1,980,803 | A | * | 11/1934 | Johnson ..... 200/6 A |
| 2,112,646 | A | | 3/1938 | Biederman |
| 2,314,590 | A | | 3/1943 | McCarty |
| 2,597,966 | A | | 5/1952 | Adler |
| 2,626,601 | A | | 1/1953 | Riley |
| 3,114,916 | A | | 12/1963 | Hadley |
| 3,184,156 | A | * | 5/1965 | Welch et al. ..... 417/440 |
| 3,236,231 | A | | 2/1966 | Schneider et al. |
| 3,362,401 | A | | 1/1968 | Katz |
| 3,382,867 | A | * | 5/1968 | Reaves ..... 128/38 |
| 3,504,665 | A | | 4/1970 | Bakunin et al. |
| 3,626,931 | A | | 12/1971 | Bysakh |
| 3,631,853 | A | | 1/1972 | Burdette, Jr. |
| 3,744,486 | A | | 7/1973 | Wilson |
| 3,763,854 | A | | 10/1973 | Welch |
| 3,841,322 | A | | 10/1974 | Spelio |
| 3,841,323 | A | | 10/1974 | Stoughton |
| 3,906,940 | A | | 9/1975 | Kawada |
| 4,003,373 | A | | 1/1977 | Spelio |
| 4,033,338 | A | | 7/1977 | Igwebike |
| 4,111,192 | A | | 9/1978 | Wu |
| 4,215,679 | A | | 8/1980 | Rustin |
| 4,428,368 | A | | 1/1984 | Torii |
| 4,531,939 | A | | 7/1985 | Izumi |
| 4,641,638 | A | | 2/1987 | Perry |
| 4,718,411 | A | | 1/1988 | Stewart |
| 4,729,368 | A | | 3/1988 | Guitay |
| 4,748,973 | A | | 6/1988 | Cho |
| 4,754,748 | A | | 7/1988 | Antowski |
| 4,790,296 | A | | 12/1988 | Segal |
| 4,836,192 | A | | 6/1989 | Abbate |
| 5,020,522 | A | | 6/1991 | Stewart |
| D320,087 | S | | 9/1991 | Sholzberg |
| 5,243,968 | A | | 9/1993 | Byun |
| 5,336,158 | A | | 8/1994 | Huggins et al. |
| 5,377,702 | A | * | 1/1995 | Sakurai ..... 132/271 |
| 5,421,808 | A | | 6/1995 | Osbon et al. |
| 5,454,778 | A | | 10/1995 | Liaskos |
| 5,462,514 | A | | 10/1995 | Harris |
| 5,470,303 | A | | 11/1995 | Leonard et al. |
| D368,140 | S | | 3/1996 | Hopper |
| 5,501,650 | A | | 3/1996 | Gellert |
| 5,573,499 | A | | 11/1996 | McAllister |
| D376,650 | S | | 12/1996 | Kain |
| D378,418 | S | | 3/1997 | Bowker et al. |
| 5,636,643 | A | | 6/1997 | Argenta et al. |
| 5,681,026 | A | | 10/1997 | Durand |
| 5,693,002 | A | | 12/1997 | Tucker et al. |
| 5,695,445 | A | * | 12/1997 | Khouri |
| 5,701,917 | A | | 12/1997 | Khouri |
| 5,725,473 | A | | 3/1998 | Taylor |
| 5,782,621 | A | | 7/1998 | Harris |
| 5,877,216 | A | | 3/1999 | Place et al. |
| 5,897,512 | A | | 4/1999 | Zagame |
| 6,017,320 | A | | 1/2000 | Bleeker et al. |
| 6,030,318 | A | | 2/2000 | Howard |
| 6,042,537 | A | | 3/2000 | Kaiser |
| 6,099,463 | A | * | 8/2000 | Hockhalter |

OTHER PUBLICATIONS

Wen, C., et al., "Atherosclerotic vascular disease of the iliohypogastric pudendal bed in females," International Journal of Impotence Research 10:S64, 1998, abstract.

http://sextoy.com/vibrat/pleaser.html, Suckers—sextoys that such the clitoris or nipples, Nov. 15, 1999.

Kohn, I., et al., "Female sexual dysfunction, What is Known and what remains to be determined," Contemporary Urology, Sep., 1999, vol. 11, No. 9, 54–72.

Appendix M., Touch II™ Vacuum Erection System Promotional Material, prior to Nov. 1999.

"Sexual responses of women, dysmenorrhea, and premenstrual tension," Obstetrics and Gynecology, Ch. 8, pp. 97–108, prior to Nov. 1999.

* cited by examiner-

Fig. 26

| INDIVIDUAL (# OF BATTERIES) | OVERALL FEEL AND DESIGN OF DEVICE | VACUUM LEVEL | EASE OF USE INCLUDING ON/OFF SWITCH | EASE OF PLACEMENT OF SUCTION CUP | INCREASE SEXUAL SATIS-FACTION FOR FEMALE (1-10) | CLITORAL ENGORGE-MENT | INCREASE VAGINAL LUBRI-CATION OVER NORMAL | INCREASE CLITORAL ORGASM OVER NORMAL | INCREASE SEXUAL SATIS-FACTION FOR PARTNER |
|---|---|---|---|---|---|---|---|---|---|
| 1 (2 BATTERIES) | SOFTER TIP AND COLOR CHANGE | FINE | NO PROBLEM | NO PROBLEM | 9 | YES | YES | YES | YES |
| 2 (2 BATTERIES) | SOFTER TIP | TOO STRONG | O.K. | O.K. | WON'T USE BECAUSE VACUUM TOO STRONG | YES | DOESN'T APPLY | DOESN'T APPLY | DOESN'T APPLY |
| 3 (1 BATTERY) | SOFTER TIP | VACUUM NOT STEADY ENOUGH | WOULD LIKE ON/OFF SWITCH | NO PROBLEM | 8 | YES | NO ANSWER | NO ANSWER | USED ALONE |
| 4 (1 BATTERY) | SOFTER TIP AND COLOR CHANGE | FINE | WOULD LIKE ON/OFF SWITCH | NO PROBLEM | 8 | YES | YES | YES | YES |
| 5 (1 BATTERY) | SOFTER TIP | WOULD LIKE TO CONTROL VACUUM | O.K. | WOULD LIKE VISUAL AID (I.E. MIRROR) | 9 | YES | YES | YES | YES |
| 6 (1 BATTERY) | SOFTER TIP | WOULD LIKE TO CONTROL VACUUM | O.K. | O.K. | 9 | YES | YES | YES | YES |

Fig. 27

CHANGES IN SENSATION

| AFTER USING THE DEVICE | WOMEN WITH FSAD (%) | WOMEN WITHOUT FSAD (%) |
|---|---|---|
| MORE THAN BEFORE | 100% | 43% |
| LESS THAN BEFORE | 0% | 0% |
| SAME AS BEFORE | 0% | 57% |
| n = | 7 | 7 |

CHANGES IN ABILITY TO ACHIEVE ORGASM

| AFTER USING THE DEVICE | WOMEN WITH FSAD (%) | WOMEN WITHOUT FSAD (%) |
|---|---|---|
| MORE THAN BEFORE | 57% | 0% |
| LESS THAN BEFORE | 0% | 0% |
| SAME AS BEFORE | 43% | 100% |
| n = | 7 | 7 |

CHANGES IN SEXUAL SATISFACTION

| AFTER USING THE DEVICE | WOMEN WITH FSAD (%) | WOMEN WITHOUT FSAD (%) |
|---|---|---|
| MORE THAN BEFORE | 86% | 14% |
| LESS THAN BEFORE | 0% | 0% |
| SAME AS BEFORE | 14% | 86% |
| n = | 7 | 7 |

CHANGES IN LUBRICATION

| AFTER USING THE DEVICE | WOMEN WITH FSAD (%) | WOMEN WITHOUT FSAD (%) |
|---|---|---|
| MORE THAN BEFORE | 86% | 29% |
| LESS THAN BEFORE | 0% | 0% |
| SAME AS BEFORE | 14% | 57% |
| I COULDN'T TELL, PARTNER YES | 0% | 14% |
| n = | 7 | 7 |

CLITORAL TREATMENT DEVICES AND METHODS

CROSS-REFERENCE TO RELATED APPLICATIONS

The subject matter of this application is related to the subject matter of U.S. patent application Nos. 60/108,959, filed Nov. 18, 1998, and 60/158,257, filed Oct. 6, 1999, both of which are incorporated herein by reference and priority to both of which is claimed under 35 U.S.C.§119(e).

BACKGROUND OF THE INVENTION

1. Field of the Invention

The invention relates to devices and methods for treating female sexual dysfunction, and more particularly, to such devices and methods that promote blood flow to the genital region, specifically the clitoris of a female patient.

2. Description of Related Art

The clitoris in the human female consists of a cylindrical, erectile organ composed of three parts: the outermost glans or head, the middle corpus or body, and the innermost crura. The glans of the clitoris is visualized as it emerges from the labia minora, which bifurcates to form the upper prepuce anteriorly and the lower frenulum posteriorly. The body of the clitoris consists of two paired corpora cavernosa of about 2.5 cm in length. The body extends under the skin at the corona to the crura. The two crura of the clitoris, formed from the separation of the most proximal portions of the corpora in the perineum, attach bilaterally to the undersurface of the symphysis pubis at the ischiopubic rami.

A fibrous tunica albuginea ensheathes each corporal body made up of lacunar space sinusoids surrounded by trabecula of the vascular smooth muscle and collagen connective tissue. No retractor clitoridis muscle exists in humans as it does in other animals such as cattle and sheep, however a supporting suspensory ligament does hold the clitoris in the introital region.

The main arterial supply to the clitoris is from the ilio-hypogastric-pudendal arterial bed. The internal pudendal artery is the last anterior branch off the internal iliac artery. Distally, the internal pudendal artery traverses Alcock's canal, then terminates as it supplies the inferior rectal and perineal artery which supply the labia. The common clitoral artery continues to the clitoris. This artery bifurcates into a dorsal clitoral artery and a cavernosal clitoral artery.

In the normal female, autonomic efferent innervation of the clitoris passes from the: pelvic and hypogastric nerves to the clitoris. Pelvic nerve stimulation results in clitoral smooth muscle relaxation and arterial smooth muscle dilation. This relaxation and dilation result in an increase in clitoral cavernosal artery inflow and an increase in clitoral intracavernous pressure, which lead to tumescence and extrusion of the glans clitoris.

Clitoral erectile insufficiency or reduced clitoral arterial flow may be caused by atherosclerosis, diabetes, or age-related causes, among other factors. Reduced clitoral arterial flow may lead to fibrosis of the clitoral cavernosa and reduced clitoral physiological function. In an animal model, Park et al. demonstrated that significant collagen build up occurs when the arterial inflow to the clitoris is compromised. This work demonstrated the importance of maintaining arterial flow to the clitoris to prevent collagen build up and fibrosis on the smooth muscle. See Park, K., et al., Vasculogenic Female Sexual Dysfunction: The Hemodynamic Basis for Vaginal Engorgement Insufficiency and Clitoral Erectile Insufficiency, IJIR, 9:27–37, 1997.

It is believed that the difficulty or inability to achieve clitoral tumescence may be related to and associated with other symptoms of female sexual arousal disorder. According to the International Consensus Report on Female Sexual Dysfunction, Female Sexual Arousal Disorder (FSAD) is defined as the persistent or recurrent inability to attain or maintain adequate genital lubrication or swelling responses resulting in personal distress. FSAD may be expressed as a lack of subjective excitement or lack of genital (lubrication/swelling) or other somatic responses (AFUD Consensus Report of FSD, 1998).

U.S. Pat. No. 5,693,002 to Tucker and U.S. Pat. No. 5,725,473 to Taylor both disclose devices for applying suction to the female clitoris. However, the devices disclosed in these patents are of a generally rudimentary and crude nature and are not suitable for e.g. clinical use. The disclosed devices provide no regulation of vacuum level, no correlation of vacuum level with degree of sexual arousal, as measured by blood-flow readings or other data, no mechanism for conveniently and easily breaking the suction once it is applied, no mechanism to modulate vacuum pressure and thereby refresh arterial blood flow, and, indeed, no mechanism of any kind for data gathering.

Other devices are known for applying suction to the male penis. One such system, known as the TOUCH II Vacuum Erection System (Mentor Urology), generates a vacuum in a cylinder disposed over the penis. After the penis is inserted into the cylinder, a pump activation button is pressed for approximately 3 seconds, facilitating and encouraging blood flow into the penis. After approximately 10 seconds of such blood flow, the pump is activated again for about 1–2 seconds. The process is repeated until a full erection is achieved. A constriction ring placed at the base of the penis impedes venous blood flow, trapping blood in the penis and allowing the erection to be maintained for intercourse. Other typical erection-aiding vacuum devices are disclosed in U.S. Pat. Nos. 5,462,514 and 5,243,968. The size, shape, suction level and/or other factors associated with such male-directed devices generally have made them unsuitable for use with the female anatomy, however. Other typically unsuitable devices are shown in e.g. U.S. Pat. Nos. 4,111,192 and 5,336,158.

A non-pharmacological approach to treatment that causes blood flow and engorgement, thereby applying a stimulus to the sensory nerve endings in the clitoris, would be very beneficial to a large group of women complaining of FSAD.

SUMMARY OF THE INVENTION

Therapeutic devices and methods according to embodiments of the invention encourage or cause clitoral engorgement to assist in the treatment of female sexual dysfunction. A vacuum is created over the clitoris, or suction is applied to the clitoris, to create a negative pressure in the clitoris that is lower than the systolic blood pressure. This tends to promote engorgement of the clitoris with blood.

More specifically, a clitoral therapy device according to an aspect of the invention includes a suction applicator, the suction applicator being constructed for placement in association with the clitoral region of a female patient, a suction source in fluid communication with the suction applicator to create suction pressure in the suction applicator, and a signal-handling device, operably coupled with at least the suction source, for handling electrical signals related to the suction pressure. The signal-handling device can be constructed to regulate the suction pressure drawn in the suction applicator, and can include a microprocessor that compares suction pressure to a variable associated with sexual arousal of the patient.

The electrical signals can include data signals, and the signal-handling device can be constructed to download the data signals to a remote location. The signal-handling device can include an on/off switch. A display, operably coupled with the suction applicator, displays a variable related to the suction pressure in the suction applicator. At least one sensor senses suction pressure in the suction applicator.

According to another aspect of the invention, a system for applying suction to the clitoral region of a female patient includes means for application to the clitoral region of the patient, means, operably coupled to the means for application, for creating a suction force at the means for application, and means for electrically powering the means for creating a suction force. The system also can include means, operably coupled to at least one of the means for application and the means for creating a suction force, for generating data related to the suction force. The system also can include means for processing the data.

The means for generating data can include at least one sensor, and the system can include means for regulating the means for creating a suction force, the means for regulating correlating suction force to a desired variable. The desired variable can be a blood-flow variable. The desired variable also can be related to sexual arousal of the patient. The system can include a memory for storing data related to operation of the system.

According to another aspect of the invention, a method of encouraging engorgement of the clitoris of a female patient includes applying a suction force to the clitoris or clitoral region of the patient, reducing intra-clitoral pressure to a level below the systolic blood pressure of the patient to encourage engorgement of the clitoris, and quantifying at least one variable, the at least one variable being chosen from the group comprising suction force and patient blood flow. The quantified variable can be displayed on a display device, and the method can include electrically powering a suction device to apply the suction force. The method also can include automatically correlating suction force to a patient variable, and the suction force can create a vacuum over the clitoris of the patient.

According to another aspect of the invention, a clitoral therapy device includes a housing, a vacuum cup in fluid communication with the housing, the vacuum cup having an opening constructed for placement over the clitoris of a female patient, an airflow device in fluid communication with the vacuum cup, the airflow device increasing suction pressure in the vacuum cup to draw blood into the female clitoris, and a modulator, operably coupled with the vacuum cup, to vary the suction pressure in the vacuum cup and promote recycling of arterial blood in the clitoris. The airflow device can include a motor.

The vacuum cup opening can be a first opening, and the modulator can include a second opening operably coupled with the vacuum cup. The second opening can be disposed in a wall of the vacuum cup for manual covering and uncovering with a human finger. A connection member connects the vacuum cup to the housing, according to this embodiment, and the second opening is disposed in the connection member. The connection member can be a generally tubular member. The second opening can be disposed in a wall of the housing. A penis-shaped motor housing can be provided, within which at least a portion of the suction source is disposed.

According to another aspect of the invention, a housing is combined with a vacuum cup, the housing being in the shape of at least a portion of a male penis, the vacuum cup being in fluid communication with the housing, and the vacuum cup having an opening constructed for placement over the clitoris of a female patient. An airflow device is in fluid communication with the vacuum cup, the airflow device increasing suction pressure in the vacuum cup to draw blood into the female clitoris.

According to another aspect of the invention, a motor cover is in the shape of at least a portion of a male penis, and a motor is disposed within the motor cover. A battery compartment is disposed within the motor cover to receive and accommodate at least one battery. A vacuum cup is in fluid communication with the motor, the motor comprising a vacuum pump for drawing a vacuum in the vacuum cup. The vacuum cup has an opening constructed for placement over the female clitoris.

According to another aspect of the invention, a method of applying suction to the clitoral region of a female patient includes providing a suction applicator constructed for close association with the clitoral region of a female patient, placing the suction applicator in fluid communication with a suction source to create suction pressure in the suction applicator, placing the suction applicator in close association with the clitoral region of a female patient, and activating the suction source to create the suction pressure.

The device further can include means, connected to the suction applicator or the suction source, for applying a topical medication to the skin of the patient in the proximity of the suction applicator. The means for applying can include a reservoir at the suction applicator or remote from the suction applicator.

A suction applicator according to an embodiment of the invention includes a soft portion constructed to contact the patient's skin and a rigid portion constructed to support the soft portion. The soft portion constructed to contact the patient's skin can include a concave shape and a convex shape immediately adjacent to the convex shape. The suction applicator also can be constructed to completely cover the vaginal labia of a female patient.

A suction-pressure varying device according to an embodiment of the invention, operably coupled with the vacuum cup, can adjust suction pressure at a more gradual rate than the modulator. The suction-pressure varying device can include a wheel in association with the housing.

Other aspects of the invention will be apparent from the remainder of this application.

BRIEF DESCRIPTION OF THE DRAWINGS

Embodiments of the invention will be described with respect to the figures, in which like reference numerals denote like elements and in which:

FIG. 26 is a table reflecting clinical data; and

FIG. 27 is an additional table reflecting clinical data.

DETAILED DESCRIPTION OF PREFERRED EMBODIMENTS

It is generally accepted that clitoral stimulation and tumescence are important aspects of female sexual arousal. Tumescence or engorgement occurs when the clitoris fills with blood. During sexual arousal, the smooth muscles within the clitoris relax and the arterial wall dilates. This causes an increase in blood flow leading to tumescence and extension of the glans clitoris.

Certain physical conditions which cause constriction of the vaginal and clitoral arteries may interfere with or prevent a woman from achieving clitoral tumescence. It is believed that the difficulty or inability to achieve clitoral tumescence may be related to other symptoms of female sexual dysfunction, such as lack of desire, difficulty achieving orgasm, insufficient vaginal lubrication, and painful intercourse. See Goldstein, I. and Berman, J., Vasculogenic Female Sexual Dysfunction: Vaginal Engorgement and Clitoral Erectile Insufficiency Syndrome. *International Journal of Impotence Research,* 10 Supplement 2, S84–S90, 1998, which is incorporated herein by reference.

Embodiments of the invention are designed to increase blood flow in the clitoris to assist a woman to achieve clitoral engorgement, and are applicable to the treatment and diagnosis of female sexual disorders. Such embodiments increase blood flow by creating a vacuum around the clitoris. The device can include a battery-operated vacuum pump and a disposable vacuum cup, for example. The vacuum cup is placed over the clitoris and the pump is activated to create a vacuum which draws blood into the clitoris, causing tumescence. The vacuum cup is attached to the vacuum pump and is activated by a button or switch on the vacuum pump or a housing thereof. A control valve, e.g. on an opposite side of the vacuum pump or housing, controls the amount of vacuum applied. The vacuum cup is supplied non-sterile, according to one embodiment, and can be cleaned e.g. with soap and water.

According to one embodiment, the device is a prescription-only device intended for single patient use. Embodiments of the invention have the potential to be used both as a non-pharmacologic treatment alternative and as long-term therapy to recondition clitoral smooth muscle and restore normal blood flow and clitoral engorgement. Further aspects of the invention will be apparent from the remainder of this description.

Figure 1:
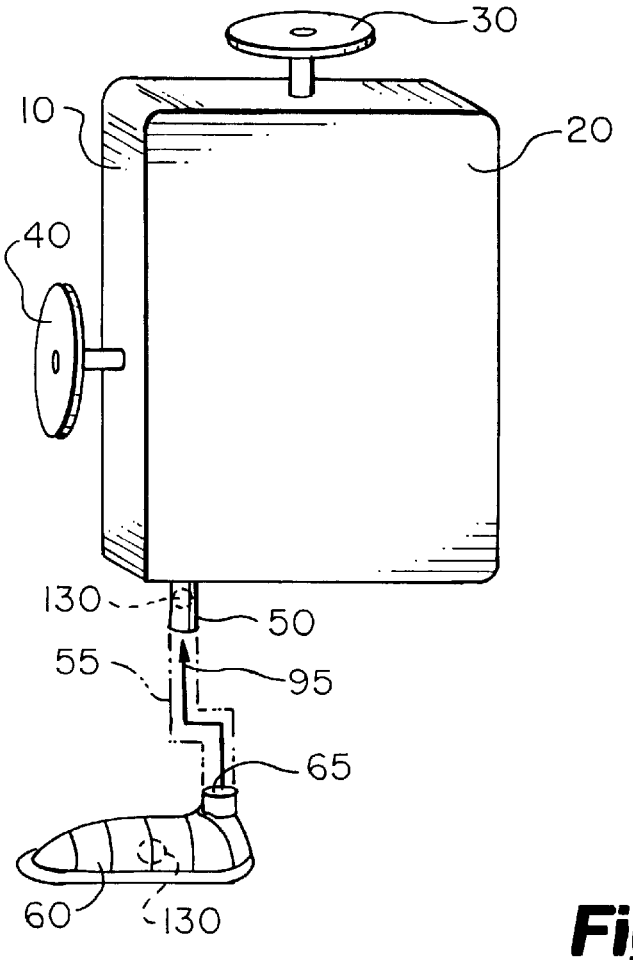
FIG. 1 is a perspective view of a clitoral therapy device according to an embodiment of the invention.
Figure 2:
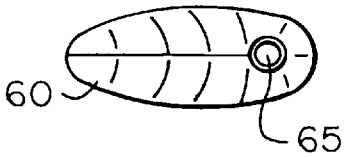
FIG. 2 is a top view of a vacuum application mechanism for use with the embodiment of FIG. 1.
Figure 3:
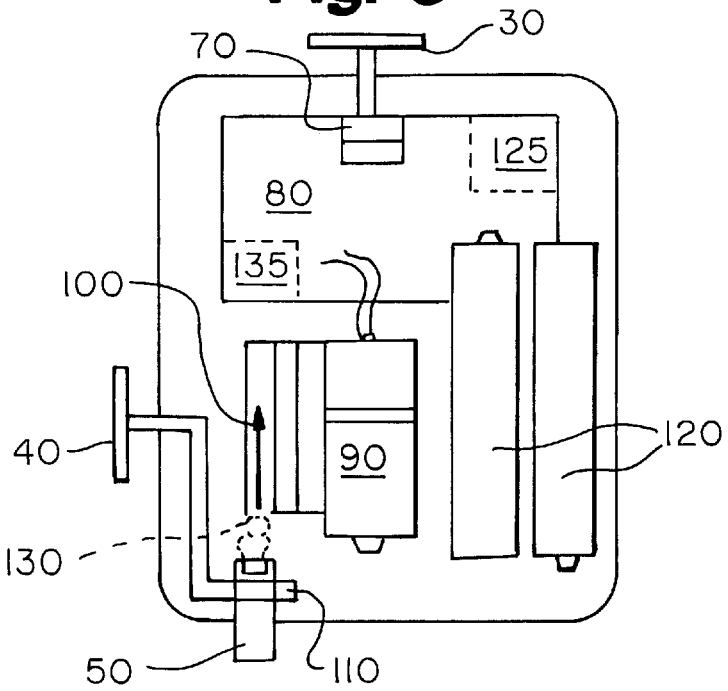
FIG. 3 is a schematic view of the clitoral therapy device of FIG. 1.
Figure 4:
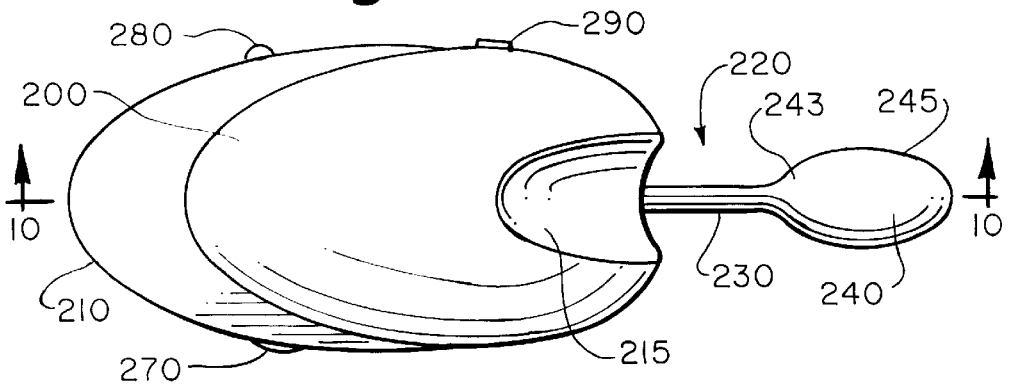
FIG. 4 is a top view of a clitoral therapy device according to an embodiment of the invention.
Figure 5:
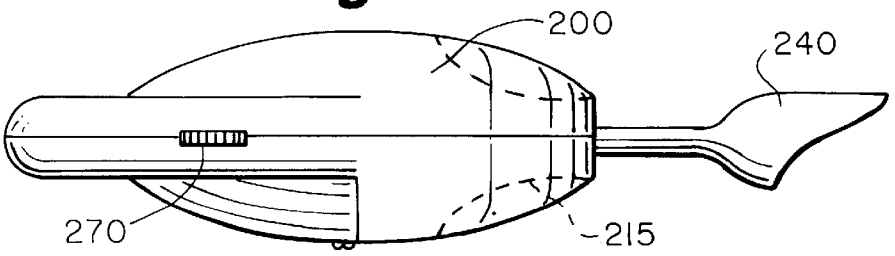
FIG. 5 is a side view of the FIG. 4 device.
Figure 6:
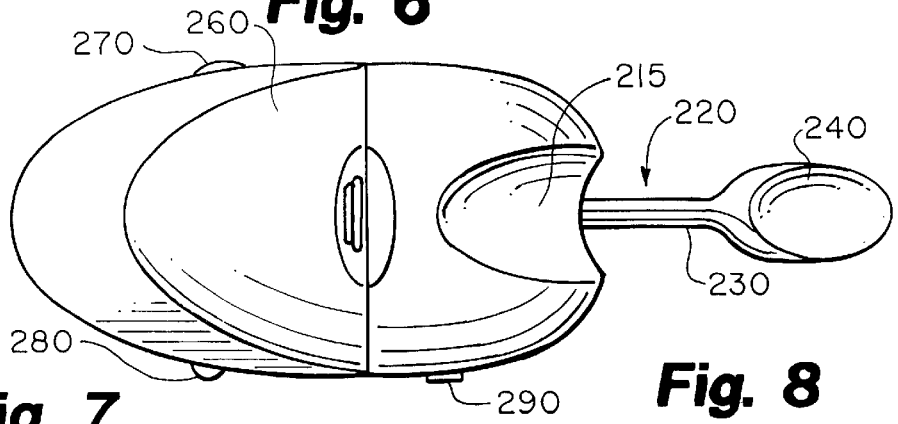
FIG. 6 is a bottom view of the FIG. 4 device.
Figure 7:
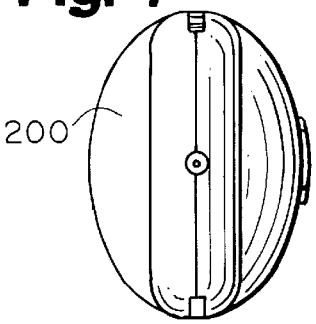
FIG. 7 is a rear view of the FIG. 4 device.
Figure 8:
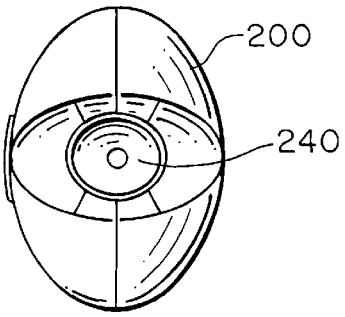
FIG. 8 is a front view of the FIG. 4 device.

One specific embodiment of a clitoral therapy device according to the invention is shown in FIGS. 1–3. Device 10 includes housing 20, which accommodates on/off switch 30, optional vacuum release 40, and vacuum connection device 50, to which a length of e.g. flexible tubing 55 or other fluid-conveying apparatus can be readily releasably connected. The end of tubing 50 remote from housing 20 supports vacuum or suction applicator 60. According to a preferred embodiment, applicator 60 preferably is a disposable vacuum or suction cup that is specially configured for application to the clitoris and/or the clitoral region. Vacuum cup 60 preferably is readily removably attached to tubing 55 at aperture 65, and/or tubing 55 is readily removably attached to connection device 50, to facilitate interchangeability of components e.g. between patients. According to preferred embodiments, applicator 60 is of elliptical shape, as shown, and is preferably soft and pliable. FIG. 2 is a top view of applicator 60.

FIG. 3 shows internal components of device 10, according to one embodiment. On/off switch 30 is mechanically, electrically, or otherwise connected to a corresponding on/off activation portion 70 of optional control electronics 80 for device 10. Electronics 80 comprise one or more signal-handling devices for handling electrical signals, e.g. data signals. Electronics 80 are operably coupled with vacuum pump/motor device 90, which is constructed to draw a vacuum or suction as indicated by arrows 95 (FIG. 1) and 100 (FIG. 3). One type of pump/motor device 90 possible for use is a small diaphragm pump available from Virtual Industries, Inc., Colorado Springs, Colo. Vacuum release 40 is operably coupled to vacuum connection device 50 and/or a portion of the housing for pump/motor 90, to effect vacuum release through vent 110, as desired.

Device 10 preferably is electrically operated, e.g. by two 1.5 volt batteries 120. However, A/C operation or operation by other battery configurations is also contemplated. Further, a manual suction or vacuum generating device, for example a squeeze ball with a one-way valve, may be used in place of pump/motor device 90.

Electronics 80 preferably include one or more processing devices 125, e.g. a microprocessor, operably connected to one or more sensing devices 130 that sense vacuum or suction pressure applied to the clitoris or clitoral region. Sensor(s) 130 can be located e.g. at pump/motor 90, vacuum cup 130, vacuum connection device 50, or some other location. Data regarding the vacuum level can be continuously or intermittently generated, monitored, and/or recorded in memory 135 of electronics 80, for later or substantially simultaneous display, downloading, and/or analysis. Further, electronics 80 can include vacuum regulation protocols that automatically correlate the amount of vacuum or suction drawn by pump/motor 90 or other device to the degree of sexual arousal (as monitored by e.g. pelvic, vaginal, clitoral, labial and/or other blood-flow measurement devices using e.g. ultrasound or impedance plethysmography, or other suitable apparatus). The correlation between vacuum and arousal can be selected according to the physiological characteristics of a particular patient, for example. Further, vacuum/suction and/or arousal data can be compared to a control or to data from other patients. Device 10 can be used in the diagnosis of blood-flow insufficiency, which is often a cause of female sexual arousal disorder.

Alternatively, electronics 80 can be substantially eliminated or reduced with on/off switch 30 substantially alone being used to activate pump/motor 90. In that case, switch 30, substantially alone, is a signal-handling device that handles electrical signals that are ultimately related to the suction pressure created. Switch 30 can also be configured such that release of switch 30 releases section pressure automatically.

In use, applicator 60 is placed over the female clitoris or clitoral region. On/off switch 30 is activated to initiate a vacuum or suction in applicator 60 via pump/motor device 90 or other source. When a desired amount of data has been read and/or stimulation achieved, on/off switch 30 can be activated again and vacuum release 40 depressed to allow the applied vacuum to be released to atmospheric or ambient pressure. With other embodiments, release or subsequent activation of on/off switch 30 serves to release the applied vacuum.

FIGS. 4–8 illustrate an additional specific embodiment of the invention. Clitoral therapy device 200 includes a generally curved outer casing 210 for comfortable and convenient gripping by a human hand. Casing 210 is injected molded using standard techniques, according to one embodiment, and preferably formed of ABS Class 6 medical-grade plastic, for example. According to one embodiment, casing 210 is formed of Dow Chemical Company's ABS Resin called MAGNUM 9555. A biocompatible material is highly preferred, to ensure that it will not cause adverse tissue reactions when placed in contact with the patient's skin.

According to one embodiment casing 210 is about 4.2 inches long and about 2.4 inches wide at its widest point. Of course, other dimensions are contemplated as well.

Externally, casing 210 preferably is water resistant or waterproof, formed with areas suitable to accommodate a company or device name or logo (e.g. by using stick-on labels or removable mold insets), and of an aesthetically pleasing color (e.g. pastel) and texture (e.g. light roughness). Indents 215 are provided for aesthetic reasons and may provide a thumbhold to allow better gripping of casing 210. Casing 210 also is sized sufficiently to accommodate a variety of internal components, to be described.

Extending from casing 210 is suction applicator 220. According to the illustrated embodiment, applicator 220 includes neck 230 ending in vacuum cup 240. According to alternative embodiments, applicator 220 can include only cup 240 with a substantially shortened or non-existent neck 230. Applicator 220 is about 2 inches long, according to one embodiment. Further, applicator 220 can be extended by tubing, for example ⅛ in. inner diameter by ¼ in. outer diameter tubing. Such tubing can be about 12 in. long, for example, and be either one-piece with applicator 220 or removably or nonremovably connected to it.

Vacuum cup 240 preferably is formed of two portions: rigid portion 243 for permanent or removable connection to neck 230, if any, and soft, skin-contacting portion 245. Rigid portion 243 advantageously is formed of a biocompatible polyethylene or polypropylene, according to one embodiment. Soft, skin-contacting portion 245 also preferably is formed of a biocompatible material, e.g. a silicone material or the thermoplastic elastomer C-FLEX available from Consolidated Polymer Technology. Skin-contacting portion 245 has a durometer of 4A, according to one embodiment, and should be pliable enough and/or shaped so as to form a vacuum-tight seal.

Applicator 220 preferably is generally translucent or transparent, at least for those portions that do not contact the patient's skin. It is also highly desirable that applicator 220, or at least vacuum cup 240, be constructed of a disposable material. Disposal between uses and/or between patients is to be encouraged, e.g. to prevent cross-contamination and promote cleanliness. Additional features of applicator 220 will be described below.

Casing 210 also includes battery door 260, which allows access to a battery compartment to be described. Of course, alternative power sources are contemplated, e.g. A/C or D/C power sources operably coupled to casing 210 and its internal components by appropriate mechanisms, e.g. wiring.

Extending from casing 210 is on/off switch 270. Switch 270 preferably is a low-noise, soft-touch device positioned for easy access by the finger or hand of the patient or the patient's partner. Switch 270 can take any of a number of known forms, e.g. a slider switch, wheel, push-button, etc.

Also extending from casing 210 is air bleed valve control 280, preferably in the form of a wheel. Air bleed wheel 210 allows adjustment of vacuum pressure, for example in the 0–10 in. Hg (inches of mercury) range, in a manner to be described. Wheel 280 preferably has a grooved texture for easy turning. Alternatives to a wheel-type activator also are contemplated, for example a slider switch or other mechanism.

Vacuum modulator 290 also optionally extends from the side of casing 210 and includes an aperture fluidly connected to the interior of casing 210. By manually covering and uncovering the aperture with e.g. a finger of the patient or of the patient's partner, suction pressure in the suction applicator can be varied, rapidly if desired, to promote stimulation of the clitoral region. Additionally, modulation of suction pressure serves to refresh arterial blood flow in the clitoris. By cycling arterial blood through the clitoris, the blood is better able to pick up collagen and accelerate its removal. Removal of collagen build up and fibrosis on the smooth muscle thus is facilitated and encouraged. Other vacuum modulation embodiments are described below.

Figure 9:
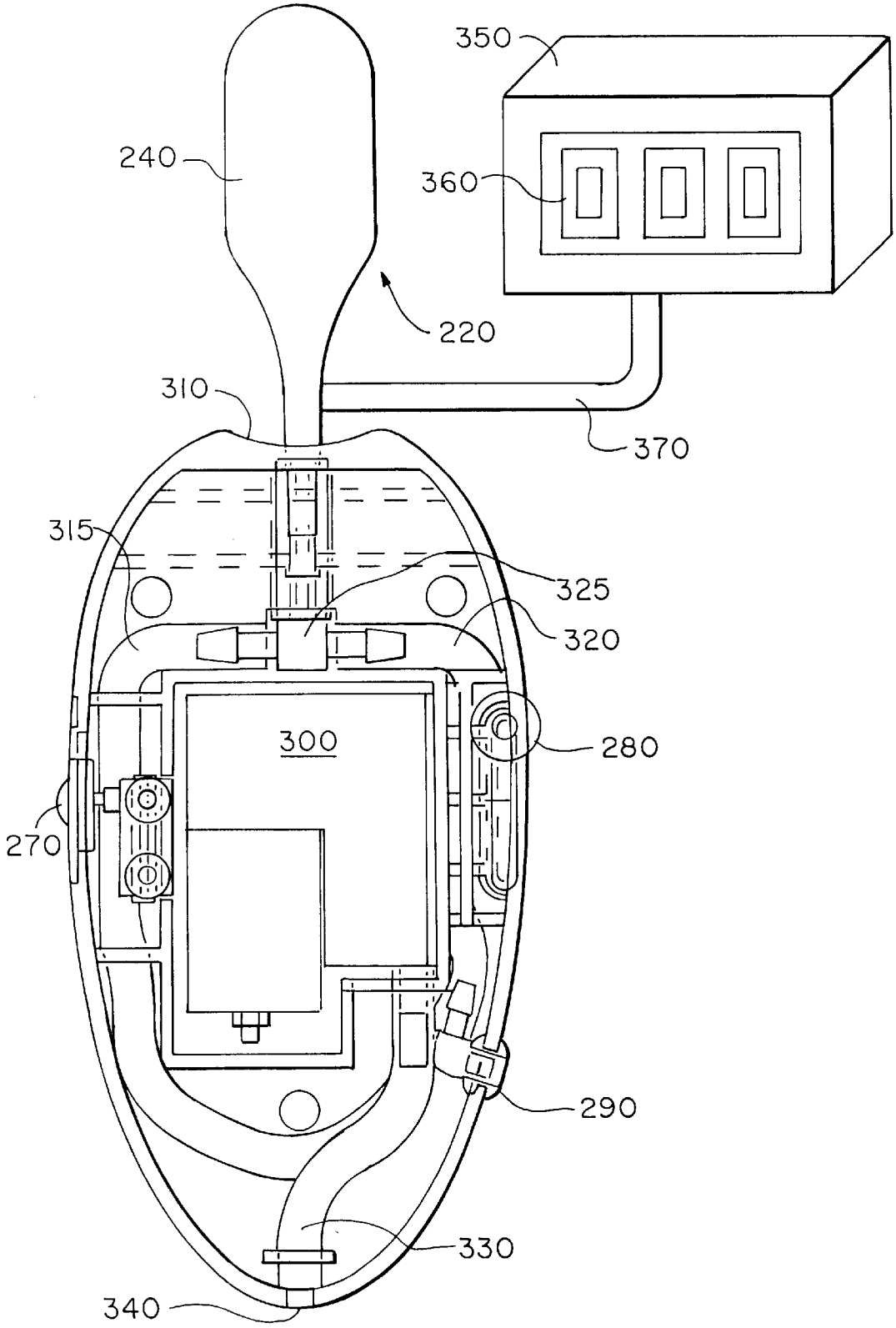
FIG. 9 is a top cross-sectional view of the FIG. 4 device, with an optional pressure gauge illustrated schematically.
Figure 10:
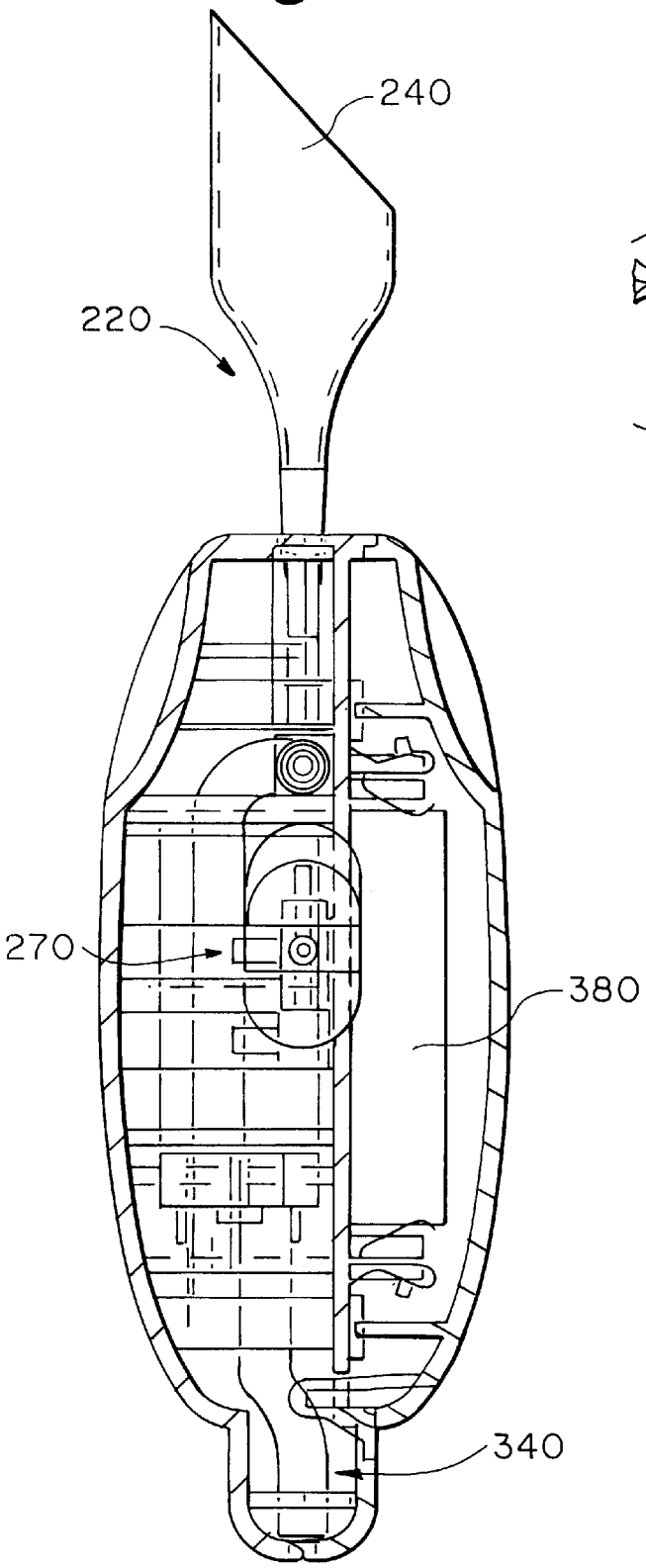
FIG. 10 is a side cross-sectional view of the FIG. 4 device.

FIGS. 9–10 show interior components within casing 210. This embodiment of the invention swaps the locations of air bleed wheel 280 and vacuum modulator 290 relative to the embodiment of FIGS. 4–8, and also adjusts the location of on/off switch 270. Of course, these switches and controls can be placed at any desired portion along casing 210.

Vacuum pump/motor assembly 300 generates a vacuum within applicator 220, drawing air through vacuum intake 310 to which applicator 220 is operably fluidly connected. Pump/motor assembly 300 is connected to intake 310 via draw tube 315, for example. Vacuum leak tube 320 extends from vacuum T-junction 325 in a direction generally opposite to draw tube 315, according to the illustrated embodiment, and is operably fluidly connected to air bleed wheel 280. Exhaust tube 330 connects pump/motor assembly 300 with exhaust port 340.

Vacuum pump/motor assembly 300 preferably pulls a vacuum of 0–10 in. Hg (inches of mercury), for example, and is constructed and arranged for smooth and quiet operation. Pump/motor assembly 300 operates at a speed compatible with air bleed system 280. An OEM Micro Air Pump available from Sensidyne, Inc., Clearwater, Fla, is an example of a pump/motor useable according to the invention, with dimensions of about 1.83 in×0.68 in×1.22 in, a weight of about 1.2 ounces and a maximum suction of about 13 in. Hg. When installed within device 200, pump/motor assembly 300 pulls a maximum of about 9.8 in Hg, according to one embodiment.

FIG. 9 also illustrates gauge 350 with digital display 360, operably coupled with applicator 220. According to one embodiment, gauge 350 is a vacuum pressure gauge displaying vacuum pressure in inches of mercury. Tube 370 is directly fluidly connected to gauge 350 and to applicator 220. A pressure transducer or other sensing element can be positioned in a desired location relative to applicator 220, tube 370 or within gauge 350 itself, as with previous embodiments.

Figure 11:
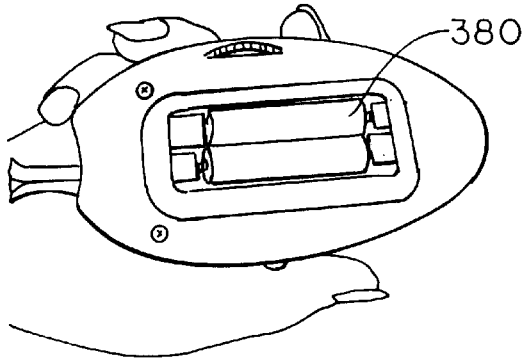
FIG. 11 is a view of the FIG. 4 device with a battery cover portion removed.

One or more batteries 380, shown in FIGS. 10 and 11, power pump/motor assembly 300 and are positioned behind battery door 260. According to one embodiment, device 200 can run for about 3–5 hours on 2 1.5 volt AAA batteries, preferably of the alkaline type. Terminals and springs provided to contact batteries 380 preferably are corrosion resistant. Proper battery insertion, is clearly marked, and the batteries preferably are easy to remove while maintaining sufficient contact.

Figure 12:
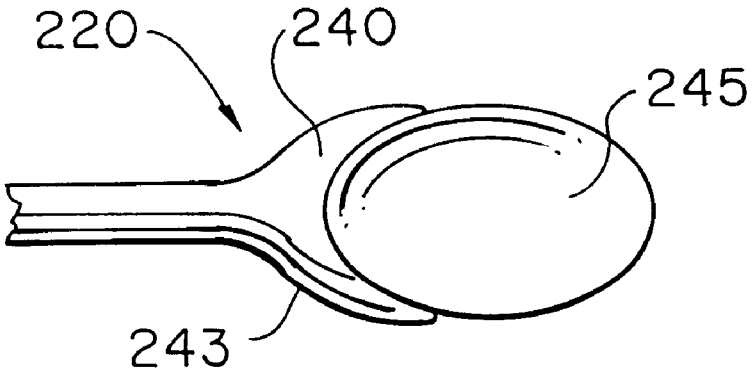
FIG. 12 is a bottom view of a vacuum cup of the FIG. 4 device.
Figure 13:
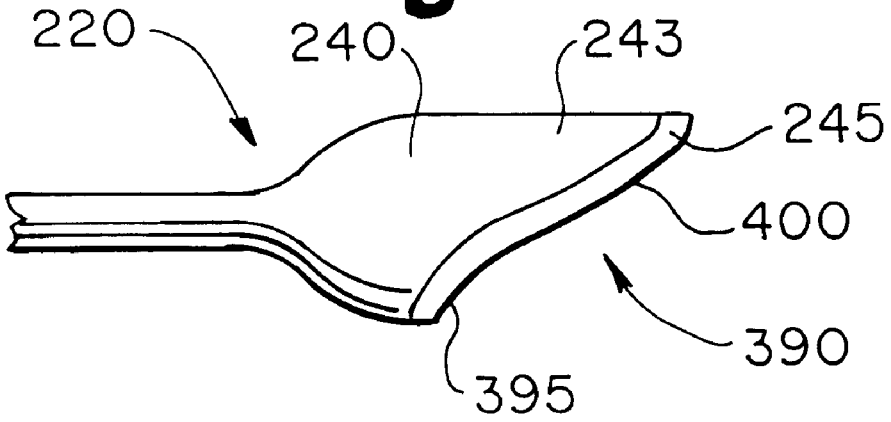
FIG. 13 is a side view of the FIG. 11 vacuum cup.

FIGS. 12–13 illustrate vacuum cup 240 of applicator 220, with rigid portion 243 and soft portion 245 as described previously. Cup 240 includes contact surface 390, which is specifically constructed and arranged for application to the clitoral region of the patient. Contact surface 390 includes concave portion 395, as shown at the lower edge of contact surface 390 in the side view of FIG. 13, and convex portion 400, as shown at the upper edge of contact surface 390. The combination of contact surface 390, soft portion 245 and underlying/supporting rigid portion 243 provides advantageous modes of contacting the clitoral region of the female patient.

Applicator 220 and/or vacuum cup 240 are specifically sized to suit the typical female clitoris. Although actual sizing can vary and can depend directly on the anatomy of the intended patient, one specific embodiment of vacuum cup 240 includes an outer diameter of about 0.90 in. and an inner diameter of about 0.75 in. Neck 230, on the other hand, includes an outer diameter of about 0.15 in. and an inner diameter of about 0.06 in., according to this embodiment.

Figure 14:
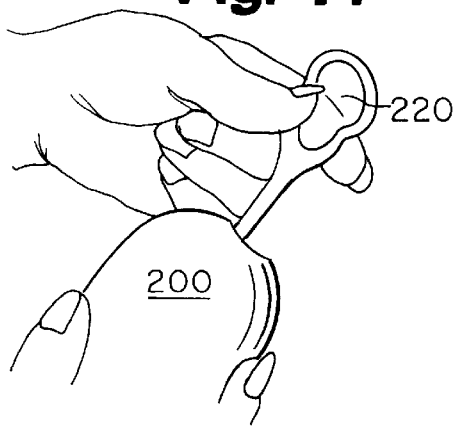
FIG. 14 is a top perspective view of the FIG. 4 device.

FIG. 14 illustrates insertion/removal of applicator 220 to/from device 200, e.g. for cleaning or disposal. Applicator 220 can be cleaned with e.g. soap and water, as can casing 210 of device 200. Applicator 220 should be completely dry before it is reconnected to device 200.

In use, applicator 220 is attached to vacuum intake 310 in casing 210, as shown in e.g. FIG. 14. The patient or partner activates device 200 by activating on/off switch 270, turning pump/motor assembly 300 on and thereby drawing air into and through applicator 220. At this point it is recommended that the patient turn air bleed wheel 280 so that the vacuum is at its lowest setting. According to one embodiment, rotation of wheel 280 toward applicator 220 decreases vacuum pressure, and rotation away from applicator 220 increases vacuum pressure.

Figure 15:
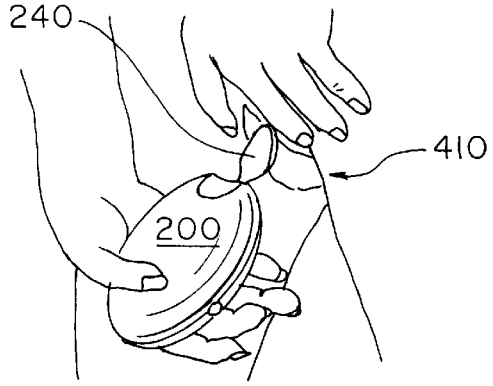
FIG. 15 shows the FIG. 14 device in use.

The labia majora (outer skin) should be gently opened, exposing the clitoris, and then vacuum cup 240 placed over the clitoris. Applying a slight pressure will gently compress soft portion 245 between rigid portion 243 and clitoral region 410, as shown in FIG. 15, obtaining a seal around the clitoris. Air bleed wheel 280 then is rotated to obtain the desired level of vacuum.

Figure 16:
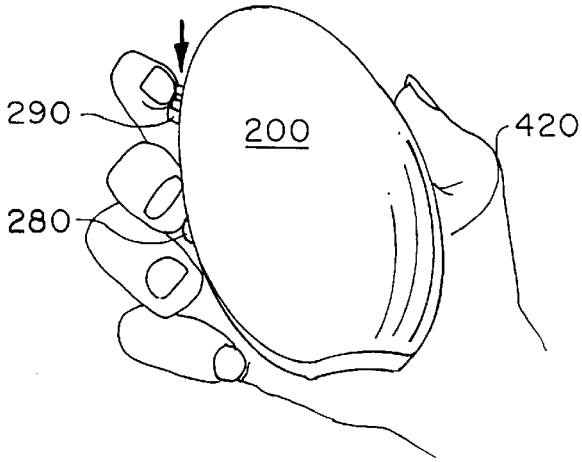
FIG. 16 shows use of a vacuum modulator according to an embodiment of the invention.

Vacuum modulator 290 then can be used to pulsate the vacuum level, as depicted in FIG. 16. The patient, or her partner, places a finger over the aperture in modulator 290 to increase vacuum level and removes the finger to decrease it. Modulator 290 has the best effect when air bleed wheel 280 is set to less than maximum vacuum. FIG. 16 also illustrates that device 200 is easily grasped in hand 420.

The vacuum applied by device 200 will cause the clitoris to become engorged, i.e. filled with blood. Vacuum level and modulation can be adjusted by either the patient or her partner, as needed, to maintain engorgement. Thus, embodiments of the invention provide the ability both to rapidly modulate vacuum pressure with modulator 290, in a manner akin to the modulation of alternating current, for example, and simultaneously to more evenly hold underlying vacuum pressure at a substantially constant level or gradually change it, e.g. with wheel 280, in a manner akin to direct current. This dual AC/DC functionality provides substantial advantages over the prior art.

Figure 17:
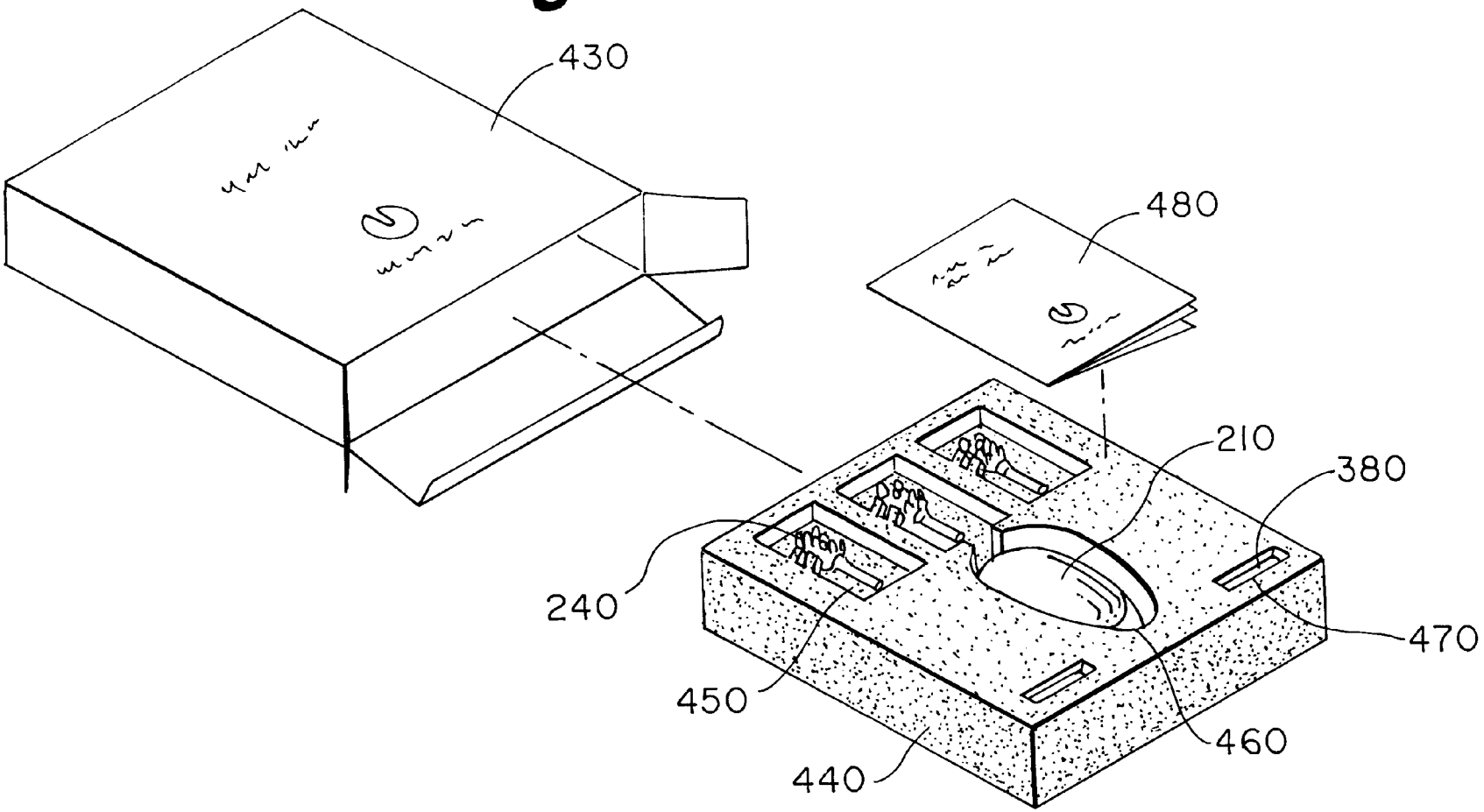
FIG. 17 shows packaging materials according to an embodiment of the invention.

FIG. 17 illustrates one packaging embodiment according to the invention. Box 430, made of cardboard or other suitable material, is of approximate dimension 7.5×7.5×2.5 inches. Of course, other dimensions to are contemplated as well. Insert 440 fits within box 430 and is made of e.g. 2 lb. density polyurethane, foam rubber or another shock-absorbing and cushioning material that generally holds its shape when uncompressed. Insert 440 defines one or more indents 450 for accommodating vacuum cups 450, indent 460 for accommodating casing 210, and one or more indents 470 for accommodating batteries 380. Patient instruction manual and/or other literature 480 preferably is disposed over insert 440.

Figure 18:
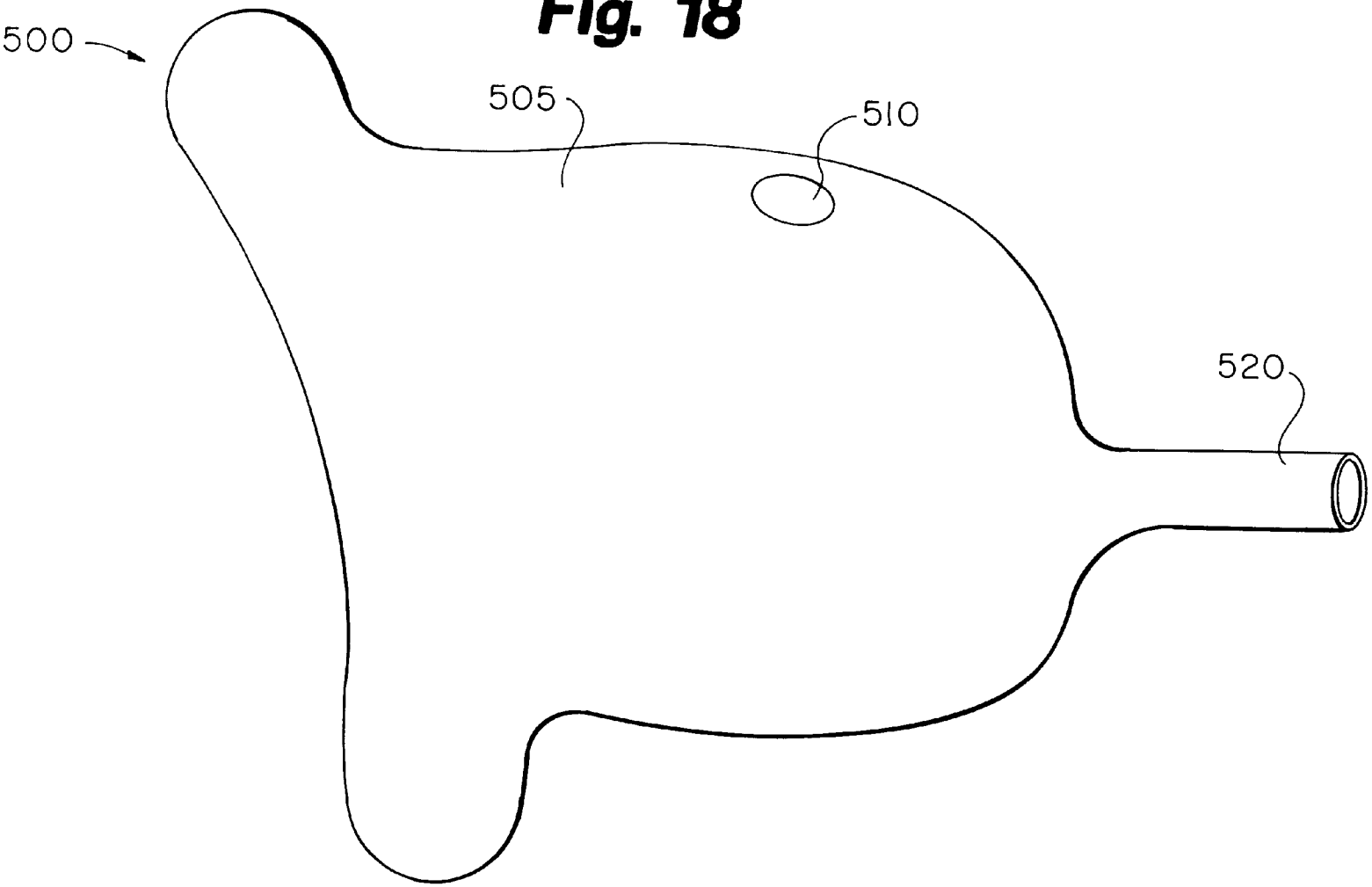
FIG. 18 shows a vacuum cup according to an embodiment of the invention.

FIG. 18 illustrates an alternative applicator embodiment. Applicator 500 of this embodiment includes vacuum cup 505 with one or more modulation ports 510 and optional neck 520. The illustrated modulation port 510 extends through a wall of vacuum cup 505 for manual covering and uncovering with a finger, as with previous embodiments. Varying the suction pressure in cup 505 in this manner tends to promote stimulation and engorgement of the clitoris, as previously described, and facilitates the removal of collagen buildup and reduction of fibrosis.

Disposing the modulation port through a wall of the vacuum cup instead of at the side of the handheld housing presents several advantages. Finger-actuated modulation of vacuum is achieved simply and effectively, and manufacturing complexity and cost are reduced. Additionally, when the patient's finger or the partner's finger is placed over the modulation hole, the hand/fingers are automatically well-placed to assist in manual stimulation of the clitoral region. Nevertheless, locating the modulation port at the housing may be less cumbersome, especially for the patient's partner.

Vacuum modulation also can be achieved by incorporating into the pump/motor assembly 300 a variable motor speed feature, or by rapidly rotating air bleed wheel 280 back and forth.

Figure 19:
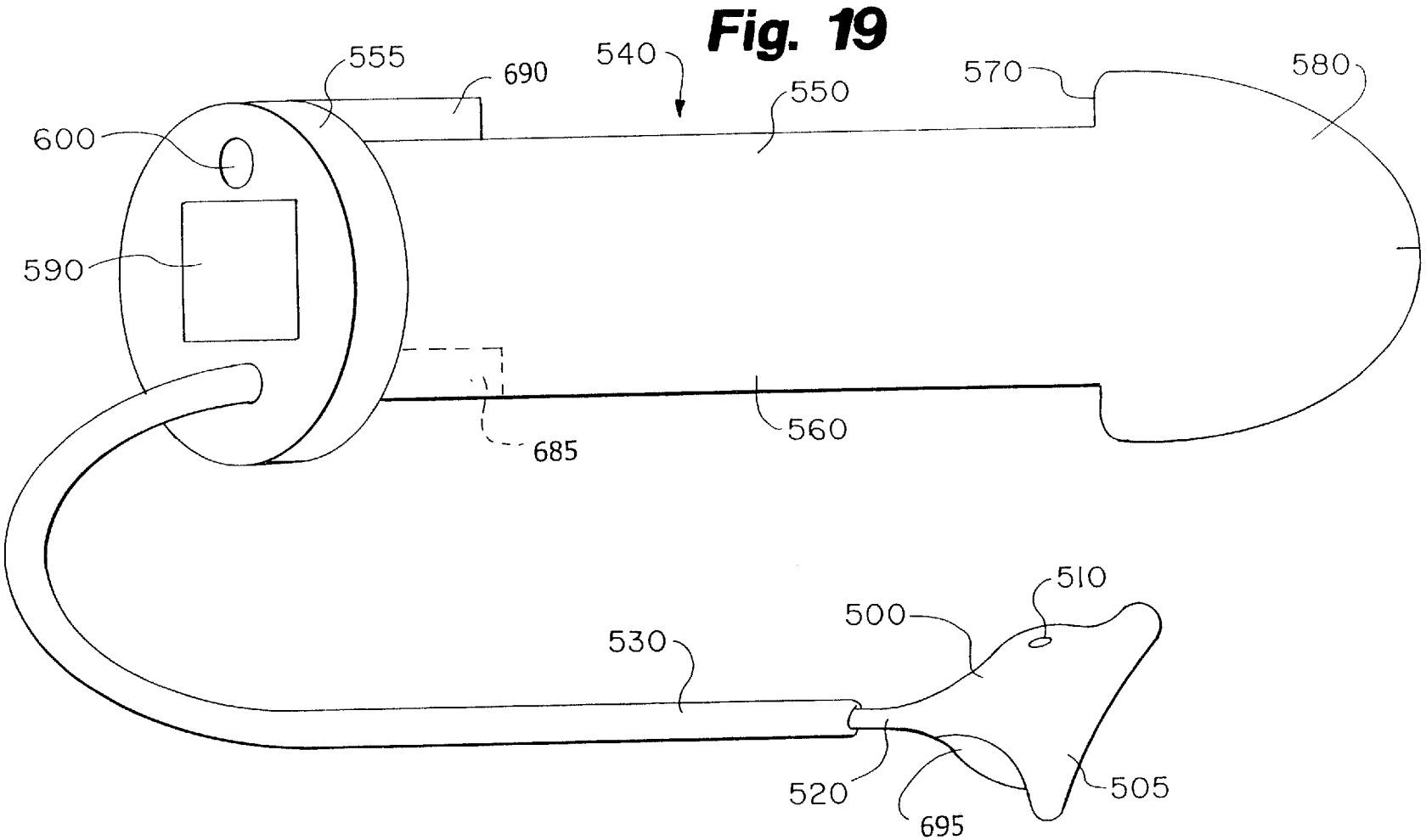
FIG. 19 shows the FIG. 18 vacuum cup in combination with a housing, according to an embodiment of the invention.
Figure 20:
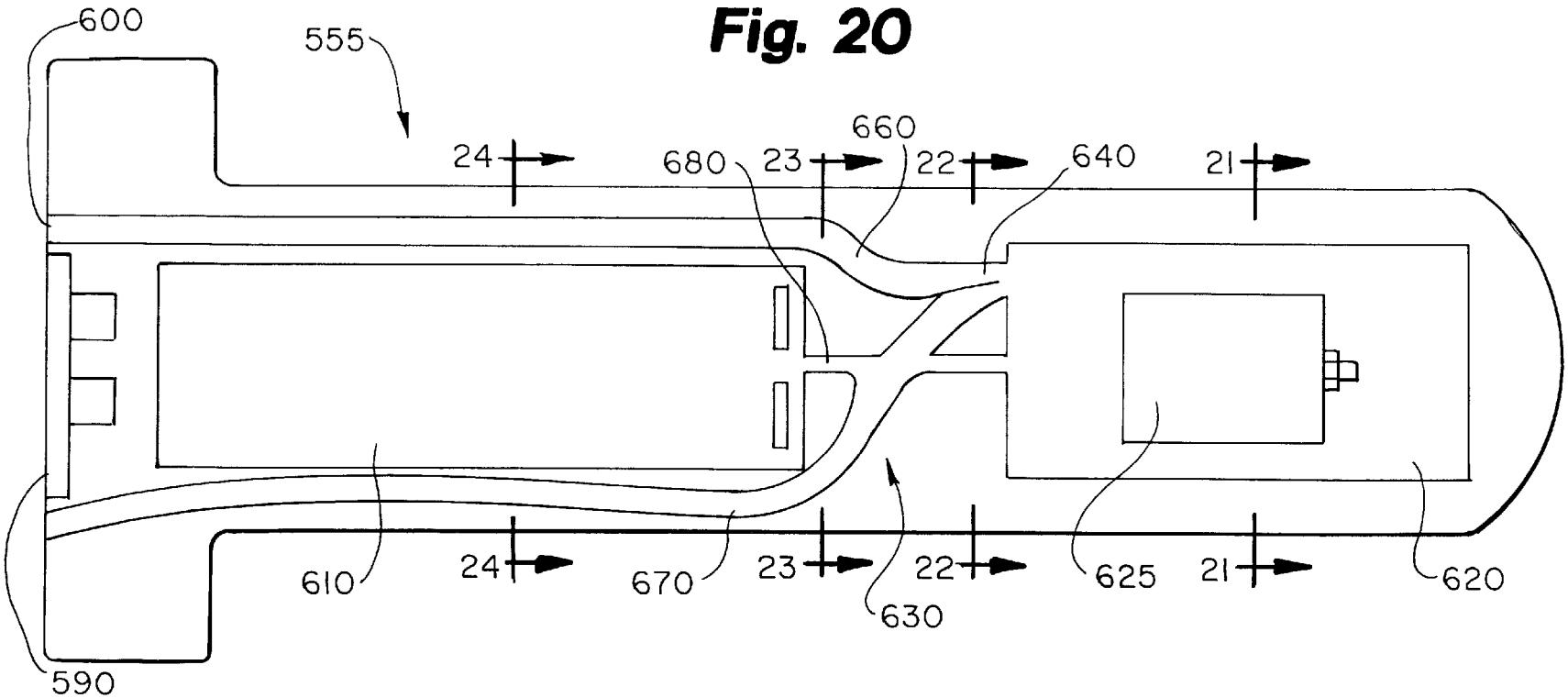
FIG. 20 is a cross-section of an internal portion disposed within the FIG. 19 housing.
Figure 21:
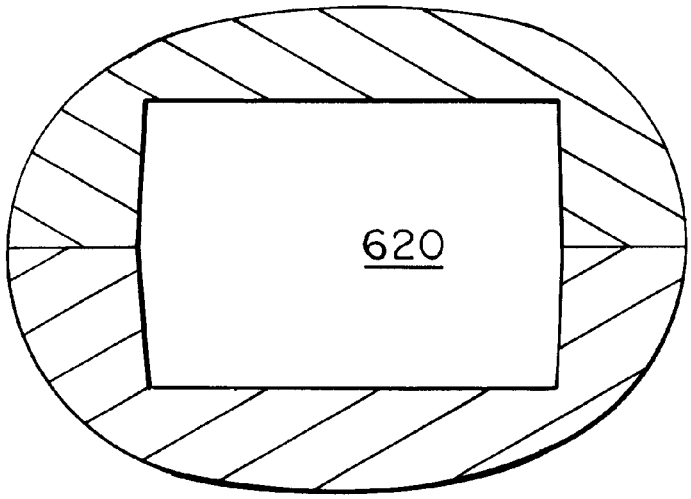
FIG. 21 is a cross-section taken along line 21—21 of FIG. 20.
Figure 22:
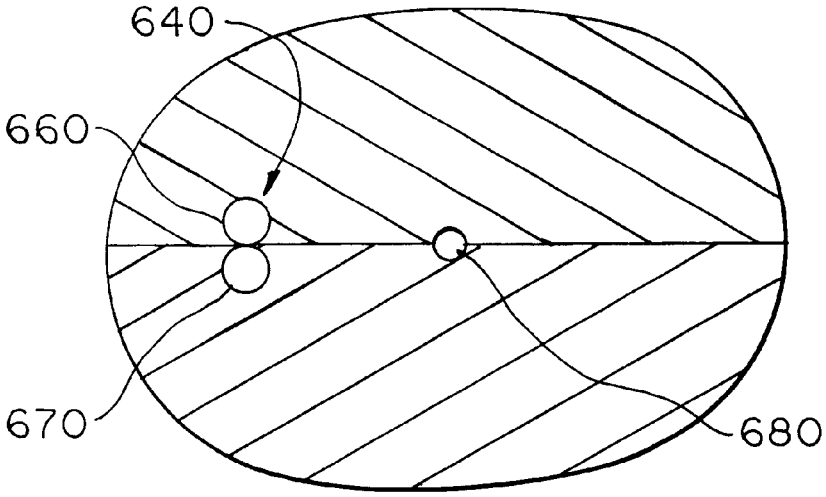
FIG. 22 is a cross-section taken along line 22—22 of FIG. 20.
Figure 23:
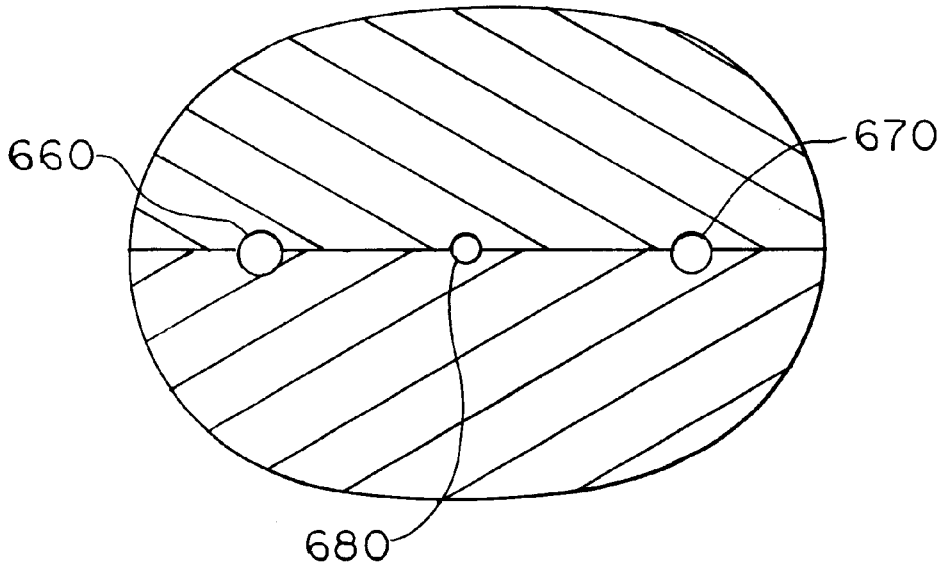
FIG. 23 is a cross-section taken along line 23—23 of FIG. 20.
Figure 24:
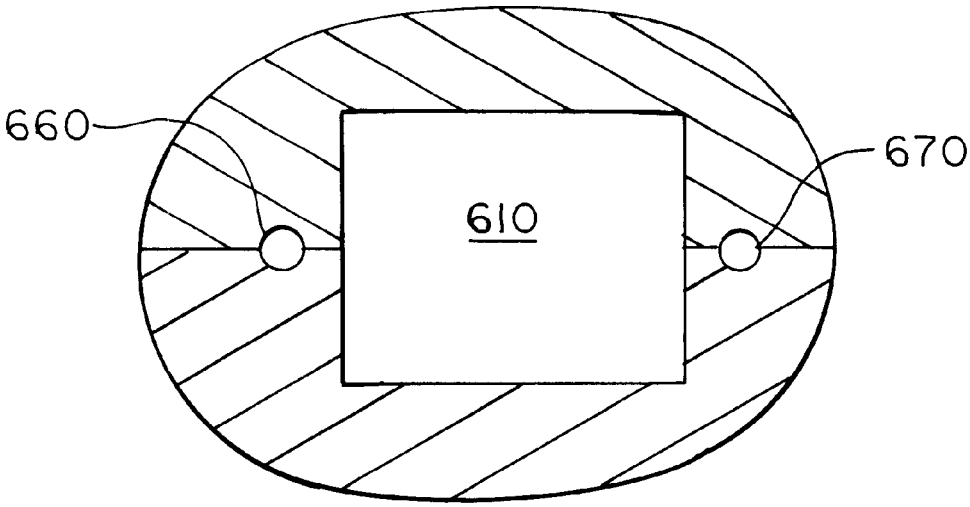
FIG. 24 is a cross-section taken along line 24—24 of FIG. 20.

FIG. 19 also illustrates applicator 500, with vacuum cup 505 attached at neck 520 to vacuum extension tube 530. Extension tube 530 runs between applicator 500 and motor assembly 540 and enhances and simplifies the ability to move and position cup 505 to a desired location. Extension tube 530 is made of the same material as cup 505, according to one embodiment, and can be molded as one-piece therewith or connected as separate pieces.

Motor assembly 540 includes sleeve or cover 550. Sleeve 550 preferably is in the shape of a penis, with shaft portion 560, glans portion 570 and tip 580. The penis-like shape of sleeve 550 should promote arousal and assist in maintaining clitoral engorgement in certain patients. Sleeve 550 also can be used for manual stimulation in conjunction with the application of vacuum. Sleeve 550 preferably is formed of a waterproof, biocompatible construction to avoid passage of fluid therethrough, for example in the manner of a condom.

Disposed within sleeve 550 is housing 555, shown in FIGS. 19–24. A portion of housing 555 extends beyond the end of sleeve 550 and includes battery door 590 and exhaust port 600, according to the illustrated embodiment. Battery compartment 610 is disposed immediately behind battery door 590 and includes suitable contacts, springs, etc. for securing e.g. 2 AAA batteries therein. Motor/pump compartment 620 houses a motor/pump assembly, a portion of which is illustrated schematically at 625.

Disposed within and along housing 555 is network 630 of tubes or passages. At portion 640 of network 630, exhaust tube 660 comes into proximity with intake (vacuum) tube 670. Wiring or wire passage 680 connects battery compartment 610 with motor/pump compartment 620. Thus, a vacuum is drawn by the motor/pump assembly via tubes 670, 530 and vacuum cup 505, with air exhausted through exhaust tube 660 and exhaust port 600.

It should be noted that sleeve 550 can be eliminated and housing 555 formed in a substantially penis-like shape or other desired shape more directly. Sleeve 550 minimizes the chances of fouling or contaminating housing 555 with fluid or other foreign matter, however, and so provides certain advantages.

Returning to FIG. 19, applicator 500 (or any of the applicators described in this application) can be used to dispense a topical medication, ointment, lubricant or other such substance to the clitoral region, preferably in conjunction with the vacuum therapy previously described. According to one embodiment, the medication or other substance is applied to an interior or exterior surface of cup 505 before patient use. According to other embodiments, a reservoir, either at cup 505 or remote from cup 505, houses the substance. Such reservoirs arm illustrated at 685 (intemal, remote), 690 (external, remote), and 695 (external, cup) in FIG. 19, although in actual practice only one such reservoir might be preferred A reservoir lining the interior surface of cup 505 is also contemplated.

The medication or other substance can be dispensed from the reservoir by manually squeezing or compressing the reservoir body, by drawing positive pressure off exhaust port 600 or exhaust tube 660, or in other ways. In the case of a remote reservoir, a supplemental dispensing tube (not shown) can run substantially parallel to and/or be attached to tube 530 to convey the medication or other substance to the interior or exterior of cup 505 or to another desired position for topical application. A reservoir at the interior or exterior of cup 505 likely is the simplest approach, e.g. with a seal being broken to begin dispensing. A reservoir at the cup also would discourage reuse of the cup, promoting cleanliness.

The combination of medicinal and vacuum therapies according to this embodiment should produce a positive synergistic effect in the promotion and maintenance of clitoral engorgement, in a manner believed heretofore unknown in the prior art. For example, a topical medication for increasing blood flow will be absorbed more quickly, and thus have greater efficacy, if blood flow through and in the clitoris is additionally increased with devices and methods according to the invention.

Additionally, a vibratory effect can be induced in the vacuum cup itself and/or in the motor housing or casing. For example, at least a portion of the cup and/or housing can be provided with or created with a bimorphic piezo material or equivalent, and/or by disposing such material or its equivalent in proximity to the vacuum cup. The piezo material is activated electrically. Alternatively, or additionally, electrical equipment can be used to modulate or pulsate the cup and/or housing. Because embodiments of the cup are substantially flexible, manually induced vibration also can be accomplished effectively without tissue irritation. Such embodiments also can be used in connection with any or all of the previously described embodiments. In the case of a vibratory housing, housing vibrations are especially well-transmitted to the cup when applicator 500 is of reduced length and/or more directly connected to the housing.

Additionally, a restriction ring, e.g. of elliptical or other shape, can be used to surround and constrict the clitoris, impeding blood outflow, in connection with the embodiments disclosed in this application. Other cup sizes are contemplated according to embodiments of the invention, large enough to cover the vagina or entire vaginal/labial region.

Figure 25:
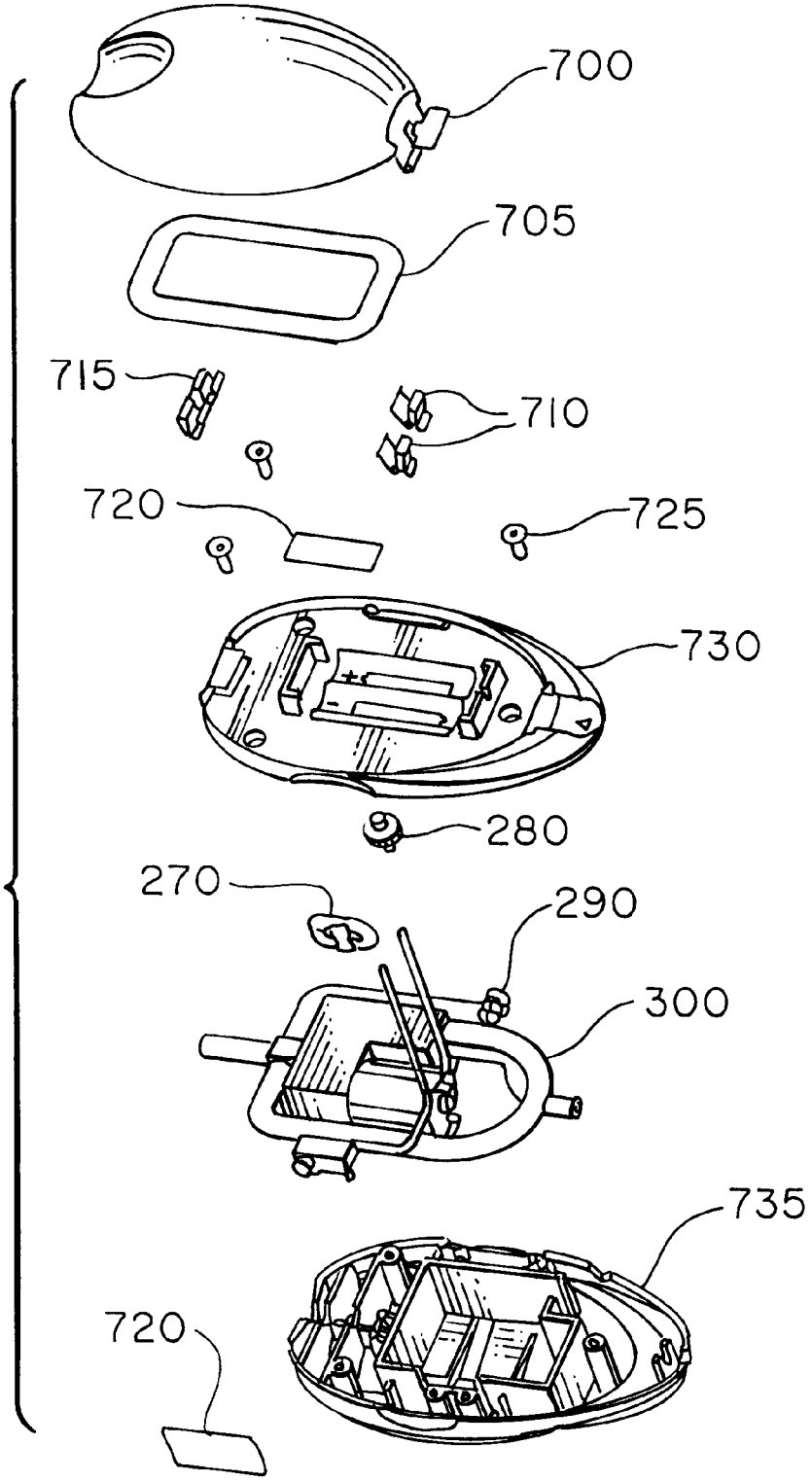
FIG. 25 is an exploded view according to an embodiment of the invention.

FIG. 25 is an exploded view according to an embodiment of the invention, with many parts thereof already described. Battery cover 700 and battery gasket 705 are disposed over batteries 380 (not shown in FIG. 25), which are secured and electrically contacted by single or double battery terminals 710, 715. Labels 720 can include appropriate written indicia, e.g. one or more company trademarks, patent notices, battery information, consumer or regulatory information, or the like. Fasteners 725, such as flathead screws or the like, secure mid cover 730 in place on base cover 735. Pump/motor assembly 300, modulation port 290, adjustment wheel 280, and on/off slide switch 270 have been described previously.

Diagnostic capabilities for the invention are many. For example, compliance of the clitoris can be compared to the vacuum level applied, for example to determine the degree of fibrosis, to optimize use of the device and maximize its effectiveness. In combination with ultrasound or other blood flow measuring devices, e.g. either clitoral or vaginal, embodiments of the invention can be used to quantify response characteristics in terms of blood velocity increase. The invention also can be used in combination with vaginal lubricity testing to evaluate reflex response caused by clitoral engorgement.

Additionally, vacuum-level and time-to-orgasm variables can be determined and compared, from use to use for a single patient and/or from patient to patient, to evaluate proper "dosage" levels—i.e. the amount of time and the level of vacuum to be prescribed for maximum effectiveness. Such levels and variables can facilitate quantitative comparisons between patients to determine the degree of FSAD. Data can be processed by a microprocessor within the unit, as described above, and/or downloaded to an external microprocessor or other computing device.

Thus, embodiments of the invention apply suction to the clitoral region of a female patient, causing or encouraging clitoral engorgement. By creating a vacuum over the clitoris, or applying suction to the clitoris or in the clitoral region, a negative pressure is created that is lower than the systolic blood pressure, resulting in engorgement of the clitoris. If used consistently, embodiments of the invention may reduce the likelihood of fibrosis and consequent reduced clitoral physiological function.

Additionally, embodiments of the invention likely are restorative to normal physiological clitoral function. By enhancing and facilitating the removal of collagen from the smooth muscle walls of the clitoris, such embodiments should tend to restore normal blood flow/ engorgement and reflex response.

Embodiments of the invention also are very small and lightweight, e.g. easily fitting into the palm or otherwise being hand held. As available pump and electronics technology advances, additional size reduction is contemplated if desired.

EXAMPLE I

Results

A first test of an embodiment of the invention was performed with 6 sexually normal female patients to monitor diurnal sexual satisfaction. Each individual used device 200 with applicator 220 for one evening of testing. The data reported by these individuals is displayed in the table of FIG. 26.

EXAMPLE II

A study of patients at Boston University, Boston, Mass. and Metropolitan Urological Specialists, St. Paul, Minn. was conducted following approval from the Institutional Review Boards of each center and informed patient consent. The goal of this study was to evaluate the safety and effectiveness of a device according to an embodiment of the invention for enhancing subjective parameters of sexual arousal in women with and without FSAD. These sexual arousal parameters included genital sensation, vaginal lubrication, ability to reach orgasm, and sexual satisfaction.

A complete medical history and physical examination, including a pelvic examination, was performed on each patient. All menopausal patients had serum estradiol and FSH levels measured and were considered menopausal if they had a lack of spontaneous menstruation for at least 12 months, or estradiol<20 ng and FSH>40 ng. A brief psychosexual history was taken by a sex therapist from all subjects prior to enrollment in the study. Patients who had a history of depression, sexual abuse, hypoactive sexual desire disorder, diabetes, dyspareunia or certain other risk factors were excluded from the study.

Each patient filled out a baseline, pre-treatment Female Intervention Efficacy Index (FIEI), a 5 item questionnaire (Chronbach's Alpha Coefficient 0.81) measuring subjective reports of changes in lubrication, sensation, orgasm, and sexual satisfaction. The FIEI is a validated questionnaire developed by Jennifer Berman, M.D. and Laura Berman, Ph.D.

Following enrollment in the study, a female nurse provided instructions on the use of the device. The patients were shown how to adjust and modulate the vacuum to their individual comfort level. The patients were then asked to practice using the device in the examination room for 5 to 10 minutes. Following this brief session, the female nurse or physician returned to the room to answer any questions and to perform a brief external genital examination.

Patients were asked to use the device in the privacy of their home with or without a partner. During the first three sessions, the patients placed the device over their clitoris and adjusted the vacuum level for an amount of time based on their own satisfaction and arousal. They continued the activation and release of the vacuum over the course of 5–15 minutes. For every home session (1–3) each patient was asked to note any changes in sexual pleasure, including clitoral and labial engorgement, orgasm, and vaginal lubrication on the FIEI. During the next three at-home sessions (4–6) the patients utilized a stopwatch to measure the length of time at which discomfort occurred and to release the vacuum at that time. They were asked to also record the time elapsed until they experienced sexual pleasure and/or orgasm. These times and events were then recorded in a patient diary.

Weekly phone interviews were held between patients and the principal investigator, nurse, or study coordinator to check on the progress of use, any negative side effects or potential problems.

A second office visit was required at the completion of the six at home sessions and within 3 months of beginning the study. During this visit, the patient was asked to fill out the FIEI again after using the device for the six sessions to compare baseline and post-treatment responses for each measured aspect of sexual arousal. An external genital examination was performed on each patient. Questionnaires and patient diaries were collected and any questions were answered.

EXAMPLE II

Results

The combined study results of the FIEI questionnaire from 14 patients at both research centers were analyzed. The 14 patients included seven women with complaints of FSAD and seven women with no sexual function complaints. Subjective reports of changes in lubrication, sensation, orgasm, and sexual satisfaction were tabulated for each cohort, and are presented in the table of FIG. 27.

As is evident from FIG. 27, the device was effective in treating symptoms of FSAD including reduced genital sensation, diminished vaginal lubrication, reduced sexual satisfaction, and diminished vaginal lubrication as determined by patient responses on the FIEI self assessment questionnaire. No evidence of clitoral trauma, bruising or irritation was observed during the final physical examination on any of the patients in the study.

Conclusion

While the invention has been described with respect to particular embodiments, the invention is by no means limited to the specific embodiments illustrated and described herein. Embodiments of the invention contemplate creating a substantial vacuum over the clitoris and/or applying a suction force over the clitoris (or, for both, in the clitoral region), and the terms "vacuum" and "suction" should be construed as including one or both concepts, as appropriate. Further, the terms "suction pressure" or "vacuum pressure" should be interpreted as encompassing pressure levels lower than atmospheric or ambient. Portions of the invention described in terms of various embodiments can be used with any other portions—for example, any of the vacuum cup embodiments disclosed herein can be used with any of the housings or casings, modulation and/or application of topical medication can be used with any of the embodiments, etc. Various other modifications and changes are readily discernable from the specification and will be apparent to those of ordinary skill.

What is claimed is:

1. A system for applying suction to the clitoral region of a female patient, the system comprising:

means for application to the clitoral region of the patient;

means, operably coupled to the means for application, for creating a suction force at the means for application;

means for electrically powering the means for creating a suction force;

a hand-sized housing for containing at least the means for creating a suction force;

means for holding substantially constant suction pressure in the means for application and for changing suction force in the means for application under manual control of the patient, the means for holding and changing being disposed through the housing; and means for manually modulating the suction pressure in the means for application, the means for manually modulating comprising an opening; wherein the hand-sized housing comprises first and second side walls; further wherein the means for modulating and the means for holding and changing are both disposed at the first side wall of the housing.

2. The system of claim 1, wherein the means for holding and changing comprises an air-bleed control valve.

3. The system of claim 1, wherein the means for electrically powering comprises at least one battery disposed within the housing.

4. A clitoral therapy device, comprising:

a hand-sized housing;

a vacuum cup connected to the housing, the vacuum cup having an opening constructed for placement over the clitoris of a female patient, the vacuum cup opening being a first opening;

an airflow device in fluid communication with the vacuum cup, the airflow device increasing suction pressure in the vacuum cup to draw blood into the female clitoris;

a manually operated air control device disposed through the housing and operably coupled with the airflow device, the manually operated air control device being adapted both to hold substantially constant suction pressure in the vacuum cup and to change suction pressure in the vacuum cup under manual control of the patient; and a manually operated modulator operably coupled with the vacuum cup to vary, under manual control of the patient, the suction pressure in the vacuum cup as held by the air control device and promote recycling of arterial blood in the clitoris, the modulator comprising a second opening fluidly coupled with the vacuum cup, the housing comprising first and second side walls, the modulator and the air control device both being disposed at the first side wall of the housing.

5. The clitoral therapy device of claim 4, wherein the airflow device comprises a motor.

6. The device of claim 4, further comprising a battery compartment disposed within the housing to receive and accommodate at least one battery.

7. The device of claim 4, wherein the vacuum cup comprises a soft portion constructed to contact the patient's skin and a rigid portion constructed to support the soft portion.

8. The device of claim 7, wherein the soft portion constructed to contact the patient's skin comprises a concave shape and a convex shape immediately adjacent to the concave shape.

9. The device of claim 4, wherein the vacuum cup is constructed to completely cover the vaginal labia of a female patient.

10. The clitoral therapy device of claim 4, wherein the air control device comprises a wheel in association with the housing.

11. The clitoral therapy device of claim 4, further comprising an on/off switch operably coupled with the airflow device.

12. The clitoral therapy device of claim 4, further comprising at least one sensor for sensing suction pressure in the vacuum cup.

13. The clitoral therapy device of claim 4, wherein the air control device comprises an air-bleed control valve.

14. The clitoral therapy device of claim 4, wherein the device is constructed such that the variation in suction pressure in the vacuum cup caused by the modulator is of greatest effect when the air control device is at a lowest suction-pressure setting.

15. The clitoral therapy device of claim 4, wherein the second opening is constructed for manual covering and uncovering with a human finger to vary the suction pressure in the vacuum cup.

16. The clitoral therapy device of claim 4, further comprising a connection member connecting the vacuum cup to the housing.

17. The clitoral therapy device of claim 16, wherein the connection member is generally rigid.

18. The clitoral therapy device of claim 16, wherein the connection member is generally flexibile.

19. The clitoral therapy device of claim 16, wherein the connection member is a generally tubular member.

20. A method of applying suction to the clitoral region of a female patient, the method comprising:

providing a suction applicator constructed for close association with the clitoral region of a female patient, the suction applicator being connected to a hand-sized housing;

placing the suction applicator in fluid communication with a suction source to create suction pressure in the suction applicator;

placing the suction applicator in close association with the clitoral region of a female patient;

activating the suction source to create said suction pressure;

holding substantially constant suction pressure in the suction applicator and changing suction pressure in the suction applicator under manual control of the patient using almanually operated air control device disposed through the housing and operably coupled with the suction source; and manually modulating the suction pressure as held by the air control device using an opening, the housing comprising first and second side walls, the opening and the air control device both being disposed at the first side wall of the housing.

21. The method of claim 20, wherein the air control device comprises an airbleed control valve.

22. The method of claim 20, further comprising manually covering and uncovering the opening with a human finger to modulate the suction pressure.

* * * * *